US007551887B2

(12) United States Patent
Ohtsuki

(10) Patent No.: US 7,551,887 B2
(45) Date of Patent: Jun. 23, 2009

(54) IMAGE FORMING DEVICE

(75) Inventor: Ryohei Ohtsuki, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 359 days.

(21) Appl. No.: 11/386,361

(22) Filed: Mar. 22, 2006

(65) Prior Publication Data

US 2006/0239734 A1 Oct. 26, 2006

(30) Foreign Application Priority Data

Apr. 22, 2005 (JP) ..... 2005-124692

(51) Int. Cl.
*G03G 15/00* (2006.01)

(52) U.S. Cl. ..... 399/401; 399/400

(58) Field of Classification Search ..... 399/400
See application file for complete search history.

(56) References Cited

U.S. PATENT DOCUMENTS 6,160,985 A * 12/2000 Hou ..... 399/384

FOREIGN PATENT DOCUMENTS

JP 61075369 A * 4/1986
JP 2002-96957 A 4/2002
JP 2002-167094 6/2002
JP 2003-095477 A 4/2003
JP 2003-182902 A 7/2003

OTHER PUBLICATIONS

Official communication issued in counterpart Japanese Application No. 2005-124692, mailed on Sep. 2, 2008.

* cited by examiner

*Primary Examiner*—Daniel J Colilla
*Assistant Examiner*—Allister Primo
(74) *Attorney, Agent, or Firm*—Keating & Bennett, LLP

(57) ABSTRACT

An image forming device includes an inner guide, a first outer guide, a second outer guide and a control device. A fusing casing is arranged between the inner guide and a heat roller. The inner guide forms a downstream end portion of a transportation path and a paper output path. The first outer guide is arranged at a position facing an open portion of a fusing casing across the transportation path, defines the downstream end portion of the transportation path together with the inner guide, and includes a hook-shaped portion curved to guide printing paper to the paper output path. The second outer guide defines the paper output path together with the inner guide, and defines an upstream end portion of the reversal path. The control device controls a linear speed of a paper output roller to be faster than a linear speed of a duplex transportation roller at a switchback transportation of the printing paper.

9 Claims, 4 Drawing Sheets

IMAGE FORMING DEVICE

BACKGROUND OF THE INVENTION

1. Field of the Invention

The present invention relates to an image forming device which is used in a copy machine, a printer, a facsimile machine, a digital Multi Function Peripheral (MFP) or the like and forms an image of a character, a figure or the like onto printing paper. More specifically, the present invention relates to an image forming device which can prevent toner fused on the printing paper from being removed or smeared.

2. Description of the Related Art

An electrophotographic image forming device is used in, for example, a copy machine, a printer, a facsimile machine, and a digital MFP including a plurality of functions such as a copy function, a printer function, a fax communication function and a scanner function. In such an image forming device, a uniformly charged electrophotographic photoconductor is selectively exposed according to image information, and an electrostatic latent image is formed. A developing device develops the electrostatic latent image, and a toner image is formed. The toner image is transferred onto printing paper (printing sheet). Then, the toner image, which has been transferred onto the printing paper but is yet to be fused, is fused onto the printing paper as a permanent image by a fusing device. The printing paper having the toner image fused thereon is transported from a transportation path to a paper output path by a pressure roller provided in the fusing device. Then, the printing paper is output onto a paper output tray by a paper output roller arranged at an end portion of the paper output path.

In such a conventional image forming device, the pressure roller and the paper output roller generally transport the printing paper having the toner fused thereon through the curved transportation path and the paper output path along a transportation guide, which defines the transportation path and the paper output path, at the same linear speed. Then, the printing paper is output onto the paper output tray. While the printing paper is being transported, an image printed side of the printing paper may make contact with the transportation guide, which defines an inner side of the curved transportation path. Immediately after the toner has been fused on the printing paper, the toner is not fixed completely. Therefore, if the image printed side of the printing paper makes contact with the inner transportation guide, the toner may be removed or smeared.

To prevent the toner from being removed or smeared while the printing paper is being transported, a known image forming device prevents the image printed side of the printing paper from making contact with the inner transportation guide. In such a known image forming device, a linear speed of the paper output roller is slower than a linear speed of the pressure roller. As a result, the transported printing paper bends, and the image printed side of the printing paper does not make contact with the inner transportation guide.

In the conventional image forming device, when carrying out a duplex printing operation in which an image of a character, a figure or the like is printed on both sides of the printing paper, first, a printing operation is performed on a first side (front side) of the printing paper. Then, the paper output roller carries out a switchback transportation of the printing paper. The paper output roller reverses a transportation direction of the printing paper, and the printing paper is transported through a reversal path. Then, the printing paper is transported into an image forming unit again by a duplex transportation roller. A toner image is transferred onto a second side (reverse side) of the printing paper, and the fusing device fuses the toner image. Then, the printing paper is transported to the paper output path by the pressure roller and output onto the paper output tray by the paper output roller. During this switchback transportation, the linear speed of the paper output roller and a linear speed of a duplex transportation roller generally have the same linear speed. In addition, after the printing operation has been performed on the second side, the linear speed of the pressure roller and the linear speed of the paper output roller are also the same. Accordingly, also in this case, the transported printing paper may make contact with the transportation guide, which defines the transportation path, the paper output path and the reversal path.

In the case of performing a duplex printing operation on the printing paper as described above, after the first side of the printing paper has been printed, the transportation direction of the printing paper is reversed and the printing paper is transported to the reversal path. In this case, if the first side having the image printed thereon makes contact with the inner transportation guide, the toner fused on the first side may be removed. Furthermore, after the second side of the printing paper has been printed, the printing paper is transported from the transportation path to the paper output path. In this case, if the first side of the printing paper makes contact with an outer transportation guide, which has been heated by a radiant heat of a heat roller, the toner fused on the first side may be remelted and removed. Therefore, the conventional image forming device does not prevent the toner from being removed or smeared when a duplex printing operation is performed on the printing paper. There is no currently available image forming device which solves this problem.

SUMMARY OF THE INVENTION

In order to overcome the problems described above, preferred embodiments of the present invention prevent toner fused on printing paper from being removed or smeared as a result of the printing paper making contact with a transportation guide when a duplex printing operation is performed on the printing paper.

According to a preferred embodiment of the present invention, an image forming device includes an image forming unit, a heat roller, a pressure roller, a fusing casing, a paper output roller, a duplex transportation roller, an inner guide, a first outer guide, a second outer guide and a control device. The image forming unit transfers a toner image onto printing paper transported through a transportation path. The heat roller heats the printing paper having the toner image transferred thereon, and melts the toner image. The pressure roller presses the printing paper against the heat roller. The pressure roller and the heat roller fuse the toner image onto the printing paper, and transport the printing paper from the transportation path to a paper output path connected to the transportation path. The heat roller is provided in the fusing casing. The paper output roller can rotate in both directions to output the printing paper, which has been transported to the paper output path, to an outer side of the image forming device, or to transport the printing paper to a reversal path connected to the paper output path when performing a duplex printing operation. The duplex transportation roller transports the printing paper, which has been transported to the reversal path, to the transportation path again. The fusing casing is arranged between the inner guide and the heat roller. The inner guide forms a downstream end portion of the transportation path and the paper output path. The first outer guide is arranged at a position facing an opened portion of the fusing casing across the transportation path. The first outer guide forms the downstream end portion of the transportation path together with the inner guide. The first outer guide includes a hook-shaped portion which is curved to guide the printing paper to the paper output path. The second outer guide forms the paper output path together with the inner guide. The second outer guide forms an upstream end portion of the reversal path. The control device controls a linear speed of the paper output roller to be faster than a linear speed of the duplex transportation roller at a switchback transportation of the printing paper.

According to at least one preferred embodiment of the present invention, at the switchback transportation of the printing paper on which an image has been formed on a first side, the linear speed of the paper output roller is faster than the linear speed of the duplex transportation roller. Therefore, during a period of time from when a leading edge of the printing paper in a transportation direction reaches a nip portion of the duplex transportation roller until when a trailing edge of the printing paper in the transportation direction separates from a nip portion of the paper output roller, the printing paper bends and does not make contact with the inner guide. As a result, the toner fused on the first side of the printing paper can be prevented from being removed.

According to at least one preferred embodiment of the present invention, after both sides of the printing paper have been printed, the control device controls the linear speed of the paper output roller to be faster than a linear speed of the pressure roller.

According to such a preferred embodiment of the present invention, after both sides of the printing paper have been printed, the control device controls the linear speed of the paper output roller to be faster than a linear speed of the pressure roller. Therefore, during a period of time from when the leading edge of the printing paper in the transportation direction reaches the nip portion of the paper output roller until when the trailing edge of the printing paper in the transportation direction passes through a nip portion between the pressure roller and the heat roller, the printing paper is pulled. As a result, the first side of the printing paper having the toner fused thereon does not make contact with the hook-shaped portion of the outer guide heated by a radiant heat of the heat roller, and the toner on the first side can be prevented from being removed.

According to another preferred embodiment of the present invention, an image forming device includes an image forming unit, a heat roller, a pressure roller, a fusing casing, a paper output roller, a duplex transportation roller, an inner guide, a first outer guide, a second outer guide and a control device. The image forming unit transfers a toner image onto printing paper transported through a transportation path. The heat roller heats the printing paper having the toner image transferred thereon, and melts the toner image. The pressure roller presses the printing paper against the heat roller. The pressure roller and the heat roller fuse the toner image onto the printing paper, and transport the printing paper from the transportation path to a paper output path connected to the transportation path. The heat roller is provided in the fusing casing. The paper output roller can rotate in both directions to output the printing paper, which has been transported to the paper output path, to an outer side of the image forming device, or to transport the printing paper to a reversal path connected to the paper output path when performing a duplex printing operation. The duplex transportation roller transports the printing paper, which has been transported to the reversal path, to the transportation path again. The fusing casing is arranged between the inner guide and the heat roller. The inner guide forms a downstream end portion of the transportation path and the paper output path. The first outer guide is arranged at a position facing an opened portion of the fusing casing across the transportation path. The first outer guide forms the downstream end portion of the transportation path together with the inner guide. The first outer guide includes a hook-shaped portion which is curved to guide the printing paper to the paper output path. The second outer guide forms the paper output path together with the inner guide. The second outer guide forms an upstream end portion of the reversal path. The control device controls a linear speed of the paper output roller to be faster than a linear speed of the pressure roller after both sides of the printing paper have been printed.

According to at least one preferred embodiment of the present invention, after both sides of the printing paper have been printed, the linear speed of the paper output roller is faster than the linear speed of the pressure roller. Therefore, during a period of time from when the leading edge of the printing paper in the transportation direction reaches a nip portion of the paper output roller until when a trailing edge of the printing paper in the transportation direction passes through a nip portion between the pressure roller and the heat roller, the printing paper is pulled. As a result, a first side of the printing paper having the toner fused thereon does not make contact with the hook-shaped portion of the outer guide heated by a radiant heat of the heat roller, and the toner on the first side can be prevented from being removed from or smeared on the printing paper.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
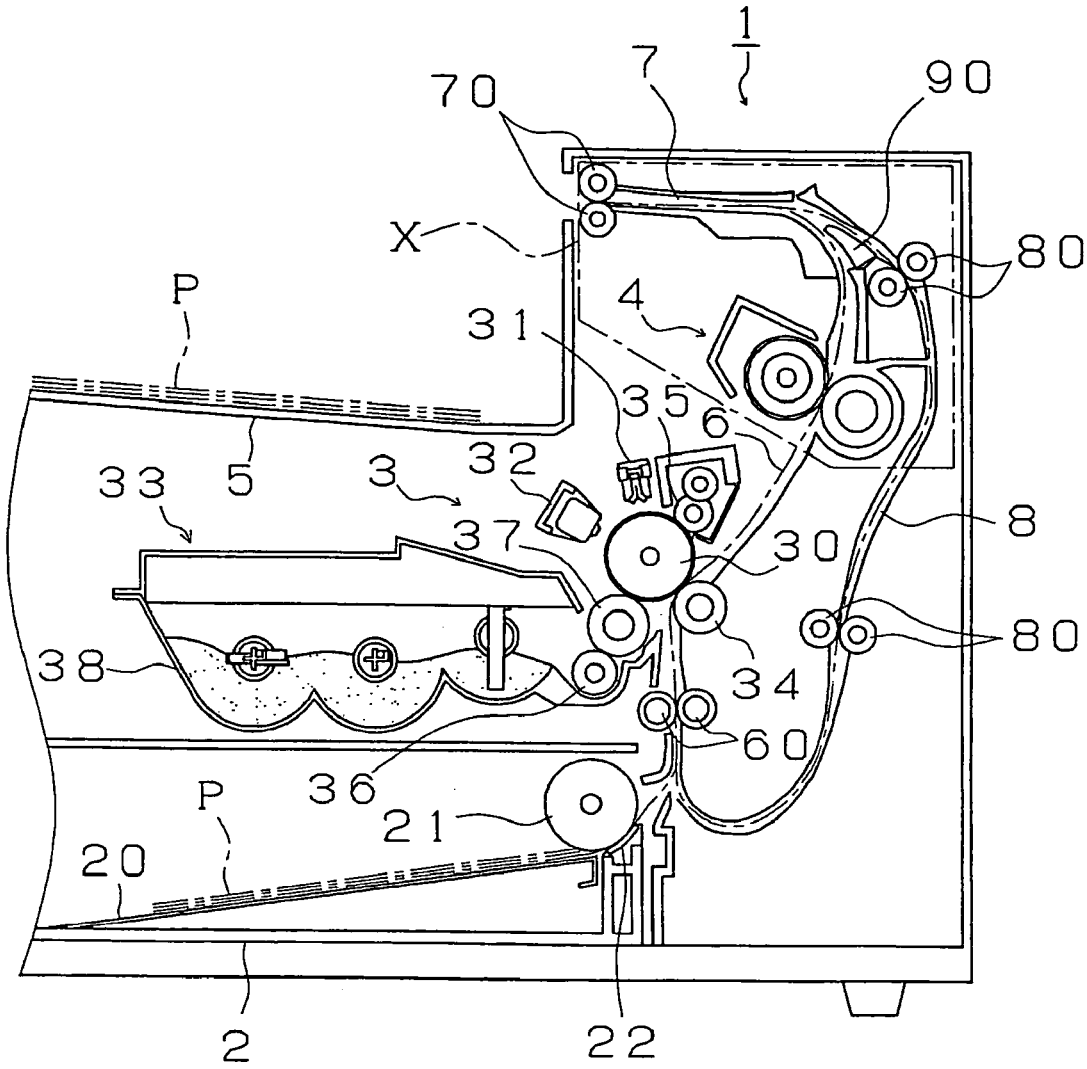
FIG. 1 is a schematic cross-sectional view illustrating an example of a structure of an image forming device according to a preferred embodiment of the present invention.

With reference to the drawings, a description will be made of a structure of an image forming device according to various preferred embodiments of the present invention. As illustrated in FIG. 1, in an image forming device 1 (hereinafter also referred to as a "device main body 1") according to a preferred embodiment of the present invention, a paper feed cassette 2 is arranged in a bottom portion of the device main body 1. The paper feed cassette 2 sequentially feeds printing papers P. An image forming unit 3 is arranged above the paper feed cassette 2. A fusing device 4 is arranged above the image forming unit 3. A paper output tray 5 is arranged to a side of the fusing device 4 and at an outer side of the device main body 1. A transportation path 6 is arranged to transport the printing papers P from the paper feed cassette 2. The transportation path 6 extends upward from one end of the paper feed cassette 2 and leads to the image forming unit 3. The transportation path 6 extends further upward and leads to the fusing device 4. Then, the transportation path 6 curves in a horizontal direction and is connected to a paper output path 7.

The paper output path 7 is arranged to be connected to the paper output tray 5. A reversal path 8 is provided for a switch-back transportation of the printing paper P. An upstream end portion of the reversal path 8 is connected to a junction of the transportation path 6 and the paper output path 7. A downstream end portion of the reversal path 8 is connected to the transportation path 6 at a portion between the paper feed cassette 2 and the image forming unit 3. Accordingly, after an image has been formed on a first side of the printing paper P, a transportation direction of the printing paper P can be reversed and an image forming operation can be performed on a second side of the printing paper P. Although not illustrated in FIG. 1, for example, when the image forming device 1 is used as a digital MFP, an image scanning unit and an operation panel are arranged above the paper output tray 5. Further, the image scanning unit functions as a Flat Bed Scanner (FBS), and the operation panel is operated to enter, for example, a start of an image scanning operation or a printing operation.

The paper feed cassette 2 is a box-shaped cassette capable of accommodating printing papers P of various sizes. The paper feed cassette 2 is arranged in the bottom portion of the device main body 1 in a manner capable of being drawn out. The printing paper P is added into the paper feed cassette 2 as needed. A guide 20 is arranged in the paper feed cassette 2. The guide 20 holds prescribed sized printing papers P at a paper feeding position. The guide 20 is arranged capable of being swung within a prescribed range. A bottom plate of the guide 20 is urged upward by a spring or the like (not illustrated). The guide 20 holds a plurality of printing papers P in a stacked state. One edge of the uppermost printing paper P is always positioned at the paper feeding position by the guide 20. A paper feed roller 21 and a separating pad 22 are arranged at the paper feeding position. The uppermost printing paper P, which is positioned at the paper feeding position by the guide 20, makes contact with the paper feed roller 21. When the paper feed roller 21 rotates, the printing papers P making contact with the separating pad 22 and a roller surface of the paper feed roller 21 are separated one sheet at a time and fed into the transportation path 6.

As illustrated in FIG. 1, the image forming unit 3 includes a photoconductive drum 30, a charging device 31, a Light Emitting Diode (LED) head 32, a developing device 33, a transfer roller 34 and a cleaning device 35. The charging device 31, the LED head 32, the developing device 33, the transfer roller 34 and the cleaning device 35 are arranged around the photoconductive drum 30. The photoconductive drum 30, the charging device 31, the developing device 33 and the cleaning device 35 are accommodated in a cartridge and provided integrally as a process unit. Therefore, when toner has run out, or when performing a maintenance work, the process unit can be removed easily from the image forming device 1.

A photoconductive layer formed by an organic photoreceptor is provided on a surface of the photoconductive drum 30. The photoconductive drum 30 rotates under a prescribed speed by a motor. The surface of the photoconductive drum 30 is charged at a constant voltage by the charging device 31. The charging device 31 is a scorotron charger using a non-contact corona charging method. Although details are not illustrated in the drawing, in the charging device 31, a discharge wire is arranged at substantially the center of a casing electrode, which forms a half space, and a grid electrode is arranged close to the photoconductive drum 30. When a prescribed voltage is applied to the discharge wire, a corona discharge is generated. The grid electrode controls an ion amount of the corona discharge. Further, the charging device 31 may use a contact-type roller charging method, or the like, in place of the non-contact corona charging method.

The LED head 32 is preferably a self-luminous printer head in which LED arrays are arranged according to a number of print pixels and a SELFOC lens array forms an image on the surface of the photoconductive drum 30 by light emitted by the LED arrays. The LED head 32 selectively exposes the surface of the photoconductive drum 30 in accordance with image information and forms an electrostatic latent image on the surface of the photoconductive drum 30. A surface potential of the surface of the photoconductive drum 30, which has been charged by the charging device 31, decays by being exposed by the LED head 32. As a result, an electrostatic latent image is formed by a potential difference between an exposed portion and a non-exposed portion. The image information is transmitted to the LED head 32 as an electric signal of an image of an original document, which has been scanned by a scanning table (not illustrated) functioning as an FBS, for example. Other than the LED head 32, the exposing device may use a scanning optical system using a semiconductor laser.

The developing device 33 includes a supply roller 36, a developing roller 37 and a toner container 38. A bias voltage is applied to each of the supply roller 36 and the developing roller 37 from an electric circuit (not illustrated). According to a difference between the bias voltage applied to the supply roller 36 and the bias voltage applied to the developing roller 37, toner in the toner container 38 is supplied via the supply roller 36 to the developing roller 37, and a toner layer is formed on a surface of the developing roller 37. The developing roller 37 having the toner layer formed thereon rotates at a position located close to the photoconductive drum 30. The toner on the developing roller 37 moves onto the photoconductive drum 30 according to a potential difference between the electrostatic latent image and the photoconductive drum 30. A toner image is formed on the surface of the photoconductive drum 30 in accordance with the electrostatic latent image. Further, such a developing device 33 is just one example. A selection of magnetic toner or non-magnetic toner, and a selection of a contact developing method or a non-contact developing method are arbitrary.

The transfer roller 34 includes an Ethylene Propylene Diene Monomer foam. The transfer roller 34 makes contact with the photoconductive drum 30 across the transportation path 6. A bias voltage is applied to the transfer roller 34 from an electric circuit (not illustrated). Under a state in which the printing paper P, which has been fed from the paper feed cassette 2 via the transportation path 6, is nipped between the photoconductive drum 30 and the transfer roller 34, when the bias voltage is applied, the toner image formed on the surface of the photoconductive drum 30 is transferred onto the printing paper P.

The cleaning device 35 is a cleaning roller which makes contact with the photoconductive drum 30 after the toner image has been transferred onto the printing paper P. A constant voltage is applied to the cleaning roller from an electric circuit (not illustrated). Accordingly, the toner or paper dust remaining on the surface of the photoconductive drum 30 is removed, and the electrostatic latent image is erased. As a result, the surface of the photoconductive drum 30 is cleaned and the photoconductive drum 30 can be used repeatedly. Further, the cleaning device 35 may also adopt another contact method using a cleaning blade or the like or adopt a non-contact method. Alternatively, a cleaningless method may be adopted in which the cleaning device 35 is not used. The toner image based on the image data of the original document, which has been scanned by the FBS (not illustrated), is transferred onto the printing paper P by the image forming unit 3 configured as described above.

As illustrated in FIG. 1 through FIG. 4, the fusing device 4 is arranged on the transportation path 6 and downstream of the photoconductive drum 30. The fusing device 4 includes a heat roller 40, a pressure roller 41 and a fusing casing 42. The heat roller 40 and the pressure roller 41 are arranged facing one another across the transportation path 6. The heat roller 40 is arranged inside the fusing casing 42 which is made heat resistant by, for example, being constructed of a heat resistant material. The fusing device 4 heats and presses the toner image on the printing paper P, which has been transported through the transportation path 6, to fuse the toner image onto the printing paper P. The surface of the heat roller 40 is maintained at a prescribed temperature by a halogen lamp 43. The heat roller 40 heats the printing paper P having the toner image transferred thereon and fuses the toner image. The pressure roller 41, including EPDM foam or the like, is pressed against the heat roller 40 under a prescribed pressure. The heat roller 40 and the pressure roller 41 are rotatable. When the printing paper P having the toner image transferred thereon is nipped between the heat roller 40 and the pressure roller 41, the toner on the printing paper P is fused onto the printing paper P.

Figure 2:
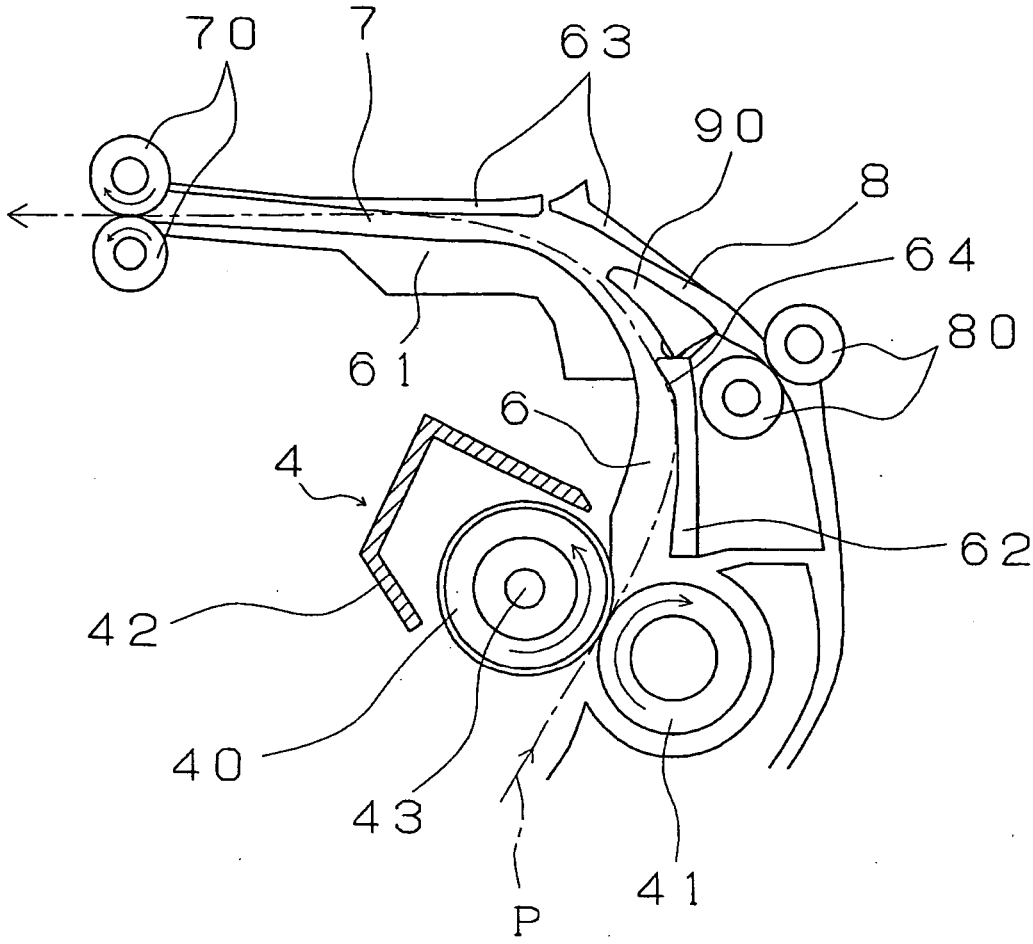
FIG. 2 is an enlarged view of an area X indicated in FIG. 1 after a first side of a printing paper has been printed.
Figure 3:
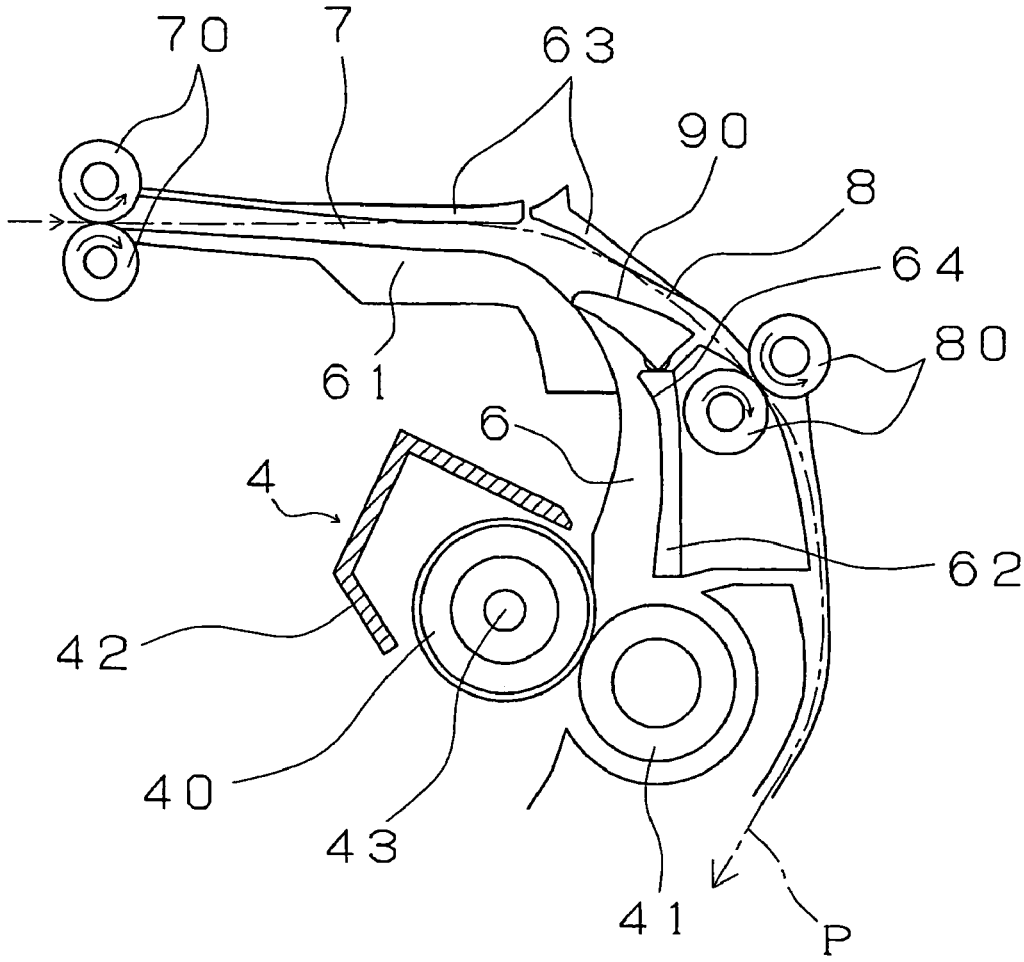
FIG. 3 is an enlarged view of the area X indicated in FIG. 1 during a switchback transportation.
Figure 4:
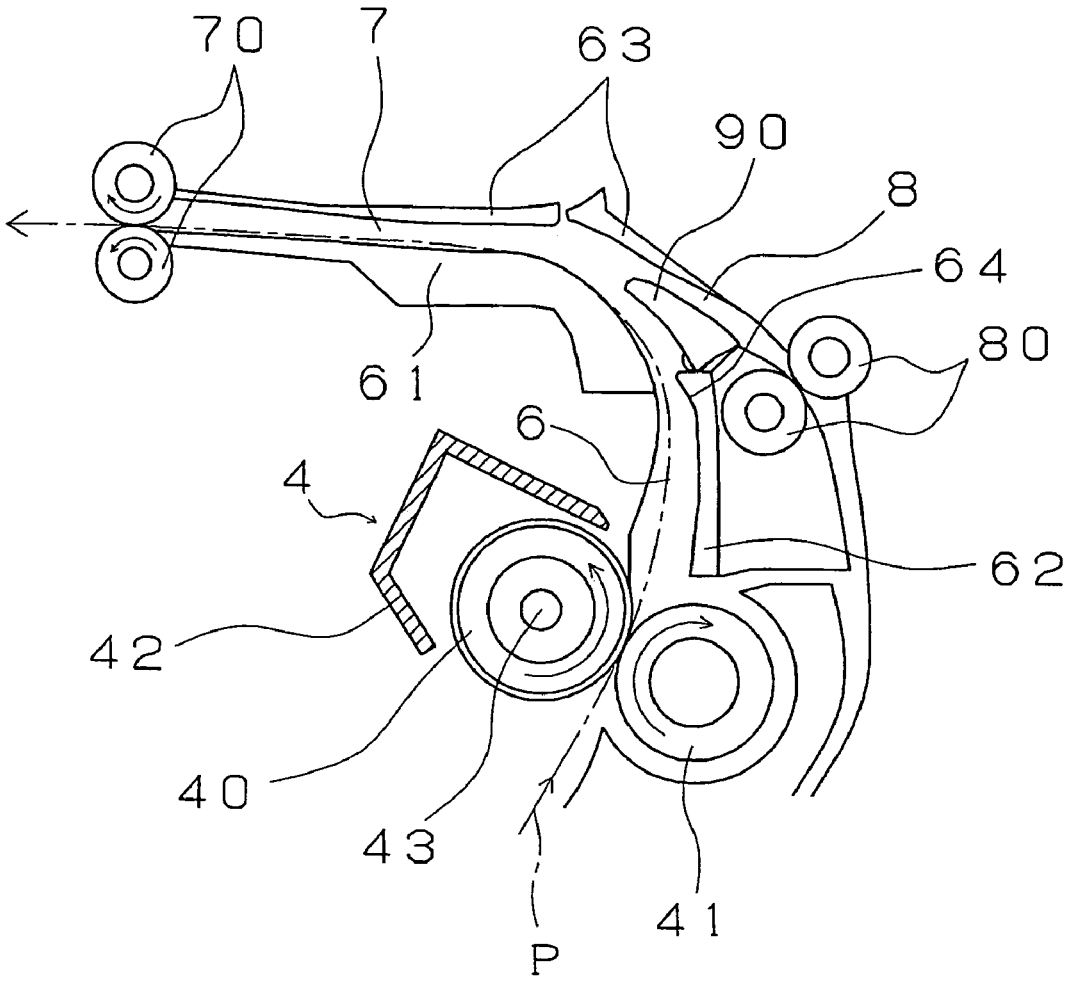
FIG. 4 is an enlarged view of the area X indicated in FIG. 1 after a second side of the printing paper has been printed.

As illustrated in FIG. 1, the transportation path 6 extends substantially upward from the paper feed cassette 2 to the image forming unit 3. A pair of resist rollers 60 are arranged midstream of the transportation path 6. The resist rollers 60 correct a transportation state of the printing paper P. The resist rollers 60 rotate in synchronism with the formation of the toner image onto the photoconductive drum 30. As illustrated in FIG. 2 through FIG. 4, a downstream end portion of the transportation path 6 located downstream of the fusing device 4 in the transportation direction makes a curve and is connected to the paper output path 7. The downstream end portion of the transportation path 6 is defined by an inner guide 61 and a first outer guide 62.

As illustrated in FIG. 1 through FIG. 4, the paper output path 7 makes a curve from a junction with the transportation path 6 and extends in a substantially horizontal direction. The paper output path 7 is defined by the inner guide 61 and a second outer guide 63. Paper output rollers 70 are arranged at an end portion of the paper output path 7 located close to the paper output tray 5. The paper output rollers 70 can rotate in both directions. Therefore, the paper output rollers 70 include an output function and a switchback transportation function. Under the output function, the paper output rollers 70 output the printing paper P, which has been transported to the paper output path 7, onto the paper output tray 5. Under the switchback transportation function, the paper output rollers 70 reverse the transportation direction of the printing paper P after the first side has been printed in the duplex printing operation and transport the printing paper P to the reversal path 8.

The upstream end portion of the reversal path 8 is connected to a junction of the transportation path 6 and the paper output path 7. The downstream end portion of the reversal path 8 joins the transportation path 6 upstream of the resist rollers 60. The second outer guide 63 defines an outer side of a curved portion of the upstream end portion of the reversal path 8. A plurality of duplex transportation rollers 80 are arranged at intervals on the reversal path 8. The duplex transportation rollers 80 transport the printing paper P, which is switchback-transported in the duplex printing operation, to a portion upstream of the resist rollers 60 in the transportation path 6.

The inner guide 61 guides the printing paper P from the transportation path 6 to the paper output rollers 70 after the toner has been fused on the printing paper P by the fusing device 4. Alternatively, the inner guide 61 guides the switchback-transported printing paper P to the reversal path 8. The inner guide 61 defines the downstream end portion of the transportation path 6, and a curved inner side and a horizontal lower side of the paper output path 7. After a single side of the printing paper P has been printed, the inner guide 61 faces the first side on which the image has been printed. After both sides of the printing paper P have been printed, the inner guide 61 faces the second side on which the image has been printed. The fusing casing 42 is located between the inner guide 61 and the heat roller 40. Therefore, the inner guide 61 is less likely to receive the radiant heat of the heat roller 40 and, therefore, less likely to be heated.

The first outer guide 62 is a transportation guide which guides the printing paper P, transported through the transportation path 6, to the paper output path 7. The first outer guide 62 defines a curved outer side of the downstream end portion of the transportation path 6. After a single side of the printing paper P has been printed, the first outer guide 62 faces the second side on which an image is not printed. After both sides of the printing paper P have been printed, the first outer guide 62 faces the first side on which an image has been printed. The first outer guide 62 includes a hook-shaped portion 64. The hook-shaped portion 64 is curved so as to guide the leading edge of the printing paper P in the transportation direction to the paper output path 7. The first outer guide 62 is arranged at a position facing an open portion of the fusing casing 42 across the transportation path 6. Therefore, the first outer guide 62 easily receives the radiant heat of the heat roller 40 and is easily heated.

The second outer guide 63 is a transportation guide for guiding the printing paper P, which is transported through the paper output path 7, to the paper output rollers 70 or guiding the switchback-transported printing paper P to the reversal path 8. The second outer guide 63 defines a horizontal upper side of the paper output path 7 and a curved outer side of the upstream end portion of the reversal path 8. After the single side of the printing paper P has been printed, or at the switchback transportation of the printing paper P, the second outer guide 63 faces the second side on which an image is not printed. After both sides of the printing paper P have been printed, the second outer guide 63 faces the first side.

A switching claw 90 is arranged in a manner capable of being swung at an upper portion of the first outer guide 62, which is also a junction of the transportation path 6, the paper output path 7 and the reversal path 8. The switching claw 90 guides the leading edge of the printing paper P in the transportation direction from the transportation path 6 to the paper output path 7 or from the paper output path 7 to the reversal path 8. The leading edge of the printing paper P in the transportation direction is guided smoothly to the paper output path 7 or the reversal path 8 by the switching claw 90.

The image forming device 1 includes a control device (not illustrated). The control device controls a linear speed V1 of the pressure roller 41, a linear speed V2 of the paper output rollers 70 and a linear speed V3 of the duplex transportation rollers 80.

Next, a description will be made of a transportation process of the printing paper P when performing a duplex printing operation on the printing paper P by the image forming device 1 configured as described above. First, a start of the duplex printing operation of the printing paper P is entered from the operation panel (not illustrated). Then, an uppermost sheet of the printing papers P in the paper feed cassette 2 is transported into the transportation path 6 by the paper feed roller 21 and reaches the resist rollers 60. The resist rollers 60 feed the printing paper P to the image forming unit 3 in synchronism with the formation of a toner image onto the photoconductive drum 30. In the image forming unit 3, the toner image is transferred onto the printing paper P from the photoconductive drum 30. The toner image on the printing paper P is melted by the heat roller 40 of the fusing device 4. The printing paper P is nipped by the heat roller 40 and the pressure roller 41, and the toner image is fused on the first side of the printing paper P. Then, as illustrated in FIG. 2, the printing paper P nipped by the heat roller 40 and the pressure roller 41 is transported from the transportation path 6 to the paper output path 7 by being guided by the hook-shaped portion 64 of the first outer guide 62 and the switching claw 90. Further, in this case, a tip end of the switching claw 90 is directed towards the second outer guide 63.

When the leading edge of the printing paper P in the transportation direction reaches a nip portion of the paper output rollers 70 at an end of the paper output path 7, the printing paper P is nipped by the paper output rollers 70 and transported towards the paper output tray 5. In this case, the control device controls the linear speed V1 of the pressure roller 41 to be faster than the linear speed V2 of the paper output rollers 70. Accordingly, as illustrated in FIG. 2, during a period of time from when the leading edge of the printing paper P in the transportation direction reaches the nip portion of the paper output rollers 70 until when a trailing edge of the printing paper P in the transportation direction passes through the nip portion between the heat roller 40 and the pressure roller 41, the printing paper P bends. As a result, the first side having the image printed thereon does not make contact with the inner guide 61, and the toner fused on the first side is not removed. Further, as a result of the printing paper P being bent, the second side may make contact with the first outer guide 62, the second outer guide 63 or the switching claw 90. However, since an image is not printed on the second side, a problem such as a removal or smearing of the toner does not occur.

Next, as illustrated in FIG. 3, when the trailing edge of the printing paper P in the transportation direction has been transported from the transportation path 6 to the paper output path 7, the paper output rollers 70 rotate backward and the transportation direction of the printing paper P is reversed for a switchback transportation. Then, the printing paper P is guided by the switching claw 90, the inner guide 61 and the second outer guide 63 and transported into the reversal path 8. Further, in this case, the tip end of the switching claw 90 is directed towards the inner guide 61. When the leading edge of the printing paper P in the transportation direction reaches a nip portion of the most upstream duplex transportation rollers 80 in the reversal path 8, the printing paper P is nipped by the duplex transportation rollers 80 and transported downstream through the reversal path 8. In this case, the control device controls the linear speed V2 of the paper output rollers 70 to be faster than the linear speed V3 of the duplex transportation rollers 80. Accordingly, during a period of time from when the leading edge of the printing paper P in the transportation direction reaches the nip portion of the duplex transportation rollers 80 until when the trailing edge of the printing paper P in the transportation direction passes through the nip portion of the paper output rollers 70, the printing paper P is bent. As a result, the first side, which is an image printed side, does not make contact with the inner guide 61 or the switching claw 90. Thus, the toner fused on the first side is not removed or smeared. Further, also in this case, as a result of the printing paper P being bent, the second side may make contact with the second outer guide 63. However, since an image is not printed on the second side yet, a problem such as a removal or smearing of the toner does not occur.

After the printing paper P has been transported through the reversal path 8, the printing paper P is transported from the downstream end portion of the reversal path 8 into the transportation path 6 again by the duplex transportation rollers 80. In the same manner as the printing operation performed on the first side, the image forming unit 3 transfers a toner image onto the second side and the fusing device 4 fuses the toner. As illustrated in FIG. 4, after both sides of the printing paper P have been printed, the printing paper P is guided by the hook-shaped portion 64 of the first outer guide 62 and the switching claw 90 and transported from the transportation path 6 to the paper output path 7 by the pressure roller 41. Further, in this case, the tip end of the switching claw 90 is directed towards the second outer guide 63.

When the leading edge of the printing paper P in the transportation direction reaches the nip portion of the paper output rollers 70, the printing paper P is nipped by the paper output rollers 70 and output onto the paper output tray 5. The control device controls the linear speed V2 of the paper output rollers 70 to be faster than the linear speed V1 of the pressure roller 41, which is opposite from the control performed after the first side has been printed. Accordingly, during a period of time from when the leading edge of the printing paper P in the transportation direction reaches the nip portion of the paper output rollers 70 until when the trailing edge of the printing paper P in the transportation direction separates from the nip portion between the heat roller 40 and the pressure roller 41, the printing paper P is pulled. Therefore, the first side does not make contact with the hook-shaped portion 64 of the first outer guide 62 and the switching claw 90. The toner fused on the first side is not remelted and removed or smeared by the heat of the hook-shaped portion 64 of the first outer guide 62.

As a result of the printing paper P being pulled, the second side having the toner fused thereon makes contact with the inner guide 61. However, since the fusing casing 42 is located between the inner guide 61 and the heat roller 40, the inner guide 61 is less likely to receive the radiant heat and be heated by the heat roller 40. Therefore, the possibility in which the toner fused on the second side remelts by the heat of the inner guide 61 is minimized. Thus, the toner is less likely to be removed when the second side makes contact with the inner guide 61 than when the first side makes contact with the hook-shaped portion 64 of the first outer guide 62.

As described above, in the image forming device 1 according to the present preferred embodiment of the present invention, when the printing paper P having the image printed on the first side is switchback-transported from the paper output path 7 to the reversal path 8, the linear speed V2 of the paper output rollers 70 is controlled to be faster than the linear speed V3 of the duplex transportation rollers 80. Therefore, during a period of time from when the leading edge of the printing paper P in the transportation direction reaches the nip portion of the duplex transportation rollers 80 until when the trailing edge of the printing paper P in the transportation direction separates from the nip portion of the paper output rollers 70, the printing paper P bends. Therefore, the printing paper P does not make contact with the inner guide 61 or the switching claw 90, and the removal or smearing of the toner fused on the first side can be prevented.

After both sides of the printing paper P have been printed, when the printing paper P is transported from the transportation path 6 to the paper output path 7, the linear speed V2 of the paper output rollers 70 is controlled to be faster than the linear speed V1 of the pressure roller 41. Therefore, during a period of time from when the leading edge of the printing paper P in the transportation direction reaches the nip portion of the paper output rollers 70 until when the trailing edge of the printing, paper P in the transportation direction passes through the nip portion between the pressure roller 41 and the heat roller 40, the printing paper P is pulled. Thus, the first side of the printing paper P having the toner fused thereon does not make contact with the hook-shaped portion 64 of the first outer guide 62 which is heated by the radiant heat of the heat roller 40. As a result, the removal or smearing of the toner from the first side is reliably prevented.

Further, the present invention is not limited to the preferred embodiment described above. Various modifications can be made without departing from the scope of the present invention. For example, transportation rollers may be arranged appropriately along the transportation path 6 and the paper output path 7 between the image forming unit 3 and the paper output tray 5, and the printing paper P may be transported by such transportation rollers in addition to the pressure roller 41 and the paper output rollers 70.

The present invention is applicable to an image forming device used in a copy machine, a printer, a facsimile machine, a digital MFP or the like.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the invention.

What is claimed is:

1. An image forming device comprising:

a transportation path;

a paper output path connected to the transportation path;

a reversal path connected to the paper output path;

an image forming unit which transfers a toner image onto printing paper transported through the transportation path;

a heat roller which heats the printing paper having the toner image transferred thereon and melts the toner image;

a pressure roller which presses the printing paper against the heat roller, fuses the toner image onto the printing paper together with the heat roller, and transports the printing paper from the transportation path to the paper output path;

a fusing casing housing the heat roller therein, the fusing casing including an open portion;

a paper output roller which is rotatable in both directions to output the printing paper transported to the paper output path to an outer side of the image forming device or to switchback-transport the printing paper to the reversal path during a duplex printing operation;

a duplex transportation roller which transports the printing paper, which has been switchback-transported to the reversal path, to the transportation path again;

an inner guide which defines a downstream end portion of the transportation path and the paper output path, the fusing casing arranged between the inner guide and the heat roller;

a first outer guide which is arranged at a position facing the open portion of the fusing casing across the transportation path and defines the downstream end portion of the transportation path together with the inner guide; wherein the first outer guide includes a hook-shaped portion curved to guide the printing paper to the paper output path;

a second outer guide which defines the paper output path together with the inner guide and defines an upstream end portion of the reversal path; and a control device which controls a linear speed of the paper output roller to be faster than a linear speed of the duplex transportation roller at the switchback transportation of the printing paper.

2. The image forming device according to claim 1, wherein the control device controls the linear speed of the paper output roller to be faster than a linear speed of the pressure roller after both sides of the printing paper have been printed.

3. The image forming device according to claim 1 wherein the control device controls a linear speed of the pressure roller to be faster than the linear speed of the paper output roller after only a single side of the printing paper has been printed.

4. The image forming device according to claim 1 wherein the fusing casing is made of a heat resistant material.

5. The image forming device according to claim 1 wherein the transportation path extends upward from one end of a paper feed cassette, through the image forming unit, past the heat roller, and curves horizontally so as to be connected to the paper output path.

6. The image forming device according to claim 1 wherein the paper output path is defined by the inner guide and the second outer guide and extends substantially in a horizontal direction while curving from a junction with the transportation path.

7. The image forming device according to claim 1 wherein the second outer guide defines an outer side of a curved portion of the upper end portion of the reversal path.

8. The image forming device according to claim 1 wherein the inner guide defines a curved portion of the downstream end portion of the transportation path and a lower side of a horizontal portion of the paper output path.

9. The image forming device according to claim 8, wherein the first outer guide defines an outer side of the curved portion of the downstream end portion of the transportation path.

* * * * *